United States Patent [19]

Andersson

[11] 4,436,587

[45] Mar. 13, 1984

[54] METHOD FOR PRODUCING MULTILAYER PAPER

[75] Inventor: Ingmar Andersson, Hammarö, Sweden

[73] Assignee: AB Karlstads Mekaniska Werkstad, Karlstad, Sweden

[21] Appl. No.: 351,470

[22] Filed: Feb. 23, 1982

[51] Int. Cl.[3] ..... D21F 11/04

[52] U.S. Cl. ..... 162/123; 162/129; 162/212; 162/213

[58] Field of Search ..... 162/123, 192, 343, 101, 162/129, 212, 213

[56] References Cited

U.S. PATENT DOCUMENTS 4,181,568 1/1980 Pfaler ..... 162/343

4,349,414 9/1982 Stenberg ..... 162/123

FOREIGN PATENT DOCUMENTS 2093879A 9/1982 United Kingdom .

*Primary Examiner*—Peter Chin

*Attorney, Agent, or Firm*—Brumbaugh, Graves, Donohue & Raymond

[57] ABSTRACT

Multilayer paper of superior layer purity and formation is produced by discharging a plurality of superimposed jets of papermaking stock from a headbox into the throat of a roll former, preventing the discharged jets from coming together for a short distance by introducing air between adjacent jets as they leave the headbox, and maintaining the velocity of the jet closest to a plain forming roll in the roll former slightly higher than the velocity of an adjacent discharged jet.

5 Claims, 3 Drawing Figures

METHOD FOR PRODUCING MULTILAYER PAPER

This invention relates to the manufacture of paper and, more particularly, to a new and improved method for making multi-ply paper of high quality in an economical and effective manner.

BACKGROUND OF THE INVENTION

It has been proposed heretofore to make multi-ply paper by discharging onto a forming wire multiple jets of papermaking stock from the slice opening of a multilayer headbox comprising essentially a plurality of stacked headboxes in a common shell. Multilayer headboxes for forming a plurality of layers simultaneously were first proposed in German Pat. No. 899,896 to Waldhof and it was there recognized that the velocities of the multiple jets of stock must be coordinated to avoid any relative speed and thus any intermixing of the stocks as they leave the slice opening. The art ever since has regarded this condition as a requirement for layer purity.

The Beck U.S. Pat. No. 3,598,696 discloses a multilayer headbox comprising upper and lower walls and intermediate partitions forming separate channels for supplying different stocks or stocks at different velocities in sequential fashion through slice openings spaced apart in the machine direction to a solid or suction breast roll. Such machines in which the layers are laid down sequentially are limited to slow machine speeds and are not suitable for the production of light weight paper such as tissue.

In recent years, exceptional layer purity has been achieved by preventing the stock jets from coming together after leaving the slice opening and for a short distance in the direction of the forming zone therefrom by the use of so-called "air wedges" that are maintained between the jets as they leave the slice opening. Highly effective methods and apparatus utilizing such "air wedge" technology are disclosed in the copending applications of Eric Gunnar Stenberg Ser. No. 210,781, filed Nov. 26, 1980, and Ser. No. 266,174, filed May 22, 1981.

SUMMARY OF THE INVENTION

Surprisingly, it has been discovered that if the velocity of the jet closest to the plain forming roll in a roll former fed by a multilayer headbox embodying the "air wedge" technology disclosed in the aforementioned copending applications is maintained slightly higher than the velocity of an adjacent discharged jet, multilayer paper of superior layer purity and formation can be obtained.

In a headbox having rigid separator vanes pivotally mounted at the upstream ends for free movement, the required velocity difference between the several channels can be obtained by suitable control of the channel geometry or the stock flows. Where the separator vanes are rigid and fixed but mounted for positional adjustment about upstream pivots, the desired velocity relations for the jets can be established by proper adjustment of the positions of the vanes and of the stock flows in the several channels, or by adjustment of the downstream end of an outer headbox wall to control the slice opening, or by control of the channel geometry.

In a preferred embodiment, the headbox has rigid separator vanes fixedly mounted at their upstream ends and the desired velocity relations for the jets can be established by adjustment of an upper or lower headbox wall to set the total slice opening, by controlling the flows in the several channels, by proper adjustment of the channel geometries, or by a combination of these.

BRIEF DESCRIPTION OF THE DRAWINGS

The invention may be better understood from the following detailed description of several representative embodiments, taken in conjunction with the accompanying drawings in which:

In FIG. 1 is shown an "air wedge" multilayer headbox 10 of the kind disclosed in the copending Stenberg application Ser. No. 266,174 for discharging a plurality of jets 11 of papermaking stock to a forming surface 12. The jets 11 are discharged into a throat 13 defined by inner and outer endless wires 14 and 15, or other foraminous forming fabrics, adapted to run over a breast roll 16 and a plain forming roll 17, respectively, in the conventional manner. If desired, a curved forming shoe or similar wire supporting member having a curved plain surface may be substituted for the plain forming roll 17.

Figure 2:
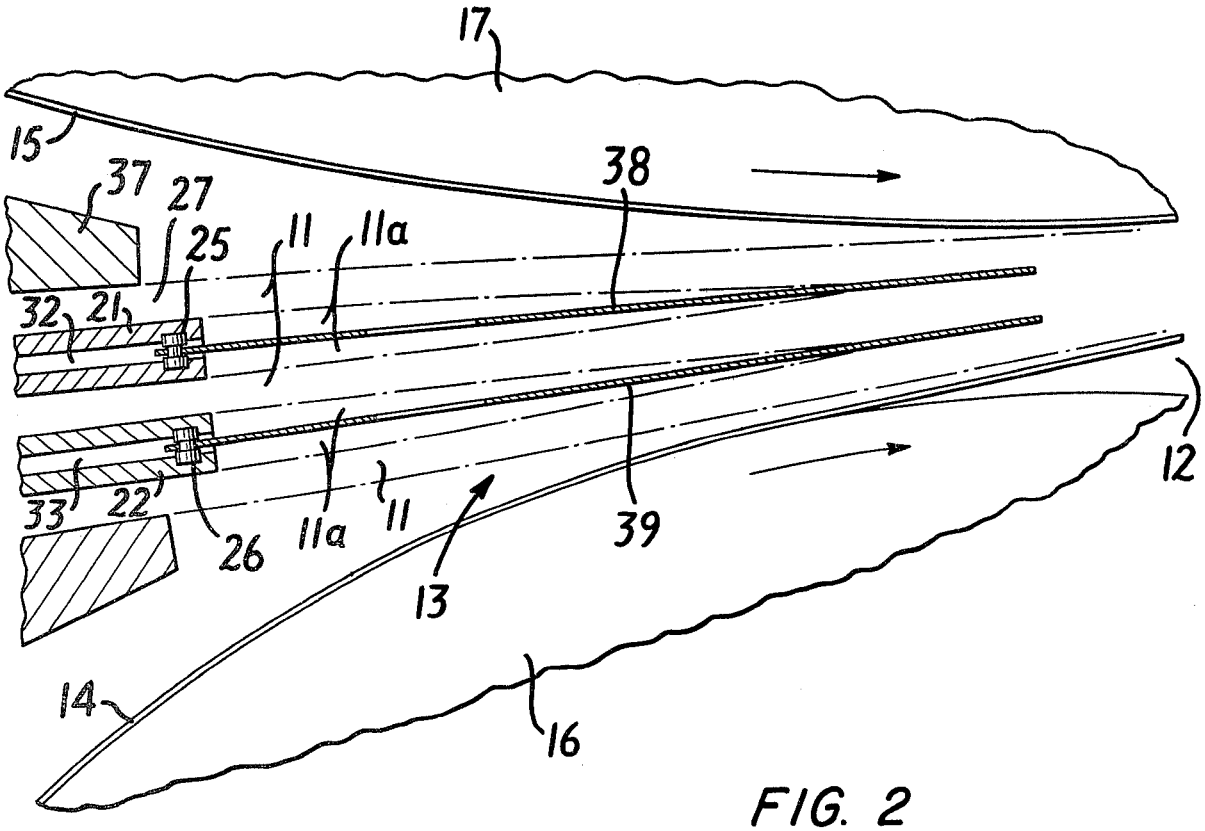
FIG. 2 is an enlarged view of the discharge end of the headbox shown in FIG. 1, showing the stock jets and the "air wedges" therebetween.

The headbox 10 is divided into a plurality of stock flow channels 18, 19 and 20 by a plurality of rigid partitions or separator vanes 21 and 22 having upstream ends 23 and 24 fixedly secured to the headbox and downstream ends 25 and 26 extending for a short distance through the headbox slice opening 27. Air or other suitable gas is supplied through the ducts 28 and 29 and passages 30 and 31 to the upstream ends of passages 32 and 33 formed in the vanes 21 and 22, respectively, for establishing and maintaining "air wedges" 11*a* (FIG. 2) between the several jets as they leave the slice opening, as disclosed in said Stenberg application Ser. No. 266,174.

Separate papermaking stocks are supplied to the channels 18, 19 and 20 through a tube bank comprising the sets of tubes 34, 35 and 36. The several stocks thus supplied are maintained under pressure as desired by separate fan pumps (not shown). Also, the upper slice lip 37 is provided with conventional means (not shown) for raising and lowering it to adjust the slice opening.

Desirably, the partition members 21 and 22 may be provided at their downstream ends with flexible foils 38 and 39 made of suitable material such as plastic. The foils 38 and 39 may be of the same width as the partitions 21 and 22 and they may extend a sufficient distance in the machine direction to keep the jets separated for a short distance after they come together at the downstream end of the air wedge. These foils eliminate any velocity component perpendicular to the planes of the jets downstream of the air wedges.

In the practice of the invention, I have found that if the stock velocity in the channel 18 adjacent the plain forming roll 17 is maintained slightly higher (e.g., in the range 1–10% but at least 15 to 20 m/min. higher) than the stock velocities in the adjacent jets, multilayer paper of superior layer purity and formation is produced.

Figure 1:
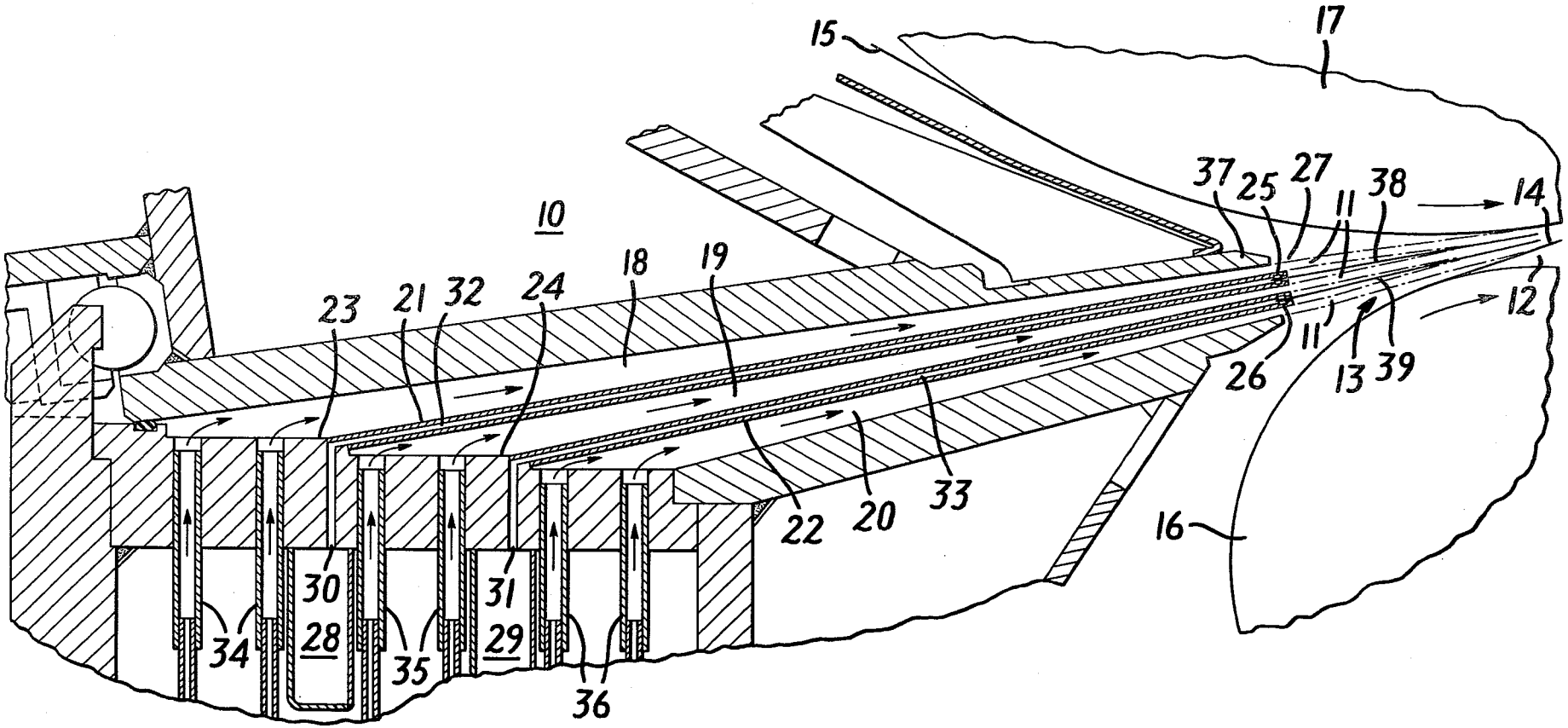
FIG. 1 is a schematic diagram of a multilayer headbox suitable for practicing the method of the invention.

In a typical reference operation, with the separator vanes 21 and 22 fixed to provide a tripled 4 mm slice opening before startup, a two layer paper was produced by running yellow-dyed hardwood fiber stock in the channel 18 and blue-dyed softwood fiber stocks in the channels 19 and 20 of a headbox like that shown in FIG. 1. After startup, the fan pump speeds for the three channels were adjusted for the 3×4 mm slice opening ratio. The jet velocities at the slice openings were then measured and found to be 952 m/min., 962 m/min., and 954 m/min. at discharge from the channels 18, 19 and 20, respectively.

The machine was run at a speed of 800 m/min. and the paper thus produced was tested for layer purity by splitting it into a plurality of layers, staining the fibers and viewing each layer under a microscope, and counting the numbers of hardwood and softwood fibers contained therein. The surface layer purity for the hardwood and softwood layers was found to be 90% and 96%, respectively.

The speed of the fan pump supplying the hardwood stock to the channel 18 was then increased until the velocity of the jet discharged therefrom was measured to be about 980 m/min., the velocities of the jets discharged from the channels 19 and 20 then being about 959 m/min. and 949 m/min. Paper was again produced with the machine running at a speed of 800 m/min. The surface layer purity of the paper thus produced, determined in the same way, was found to be 94% and 98%, respectively, for the hardwood and softwood layers, substantially higher than in the reference run. The improvement in layer purity and formation was readily apparent upon inspection of samples produced from dyed stocks.

Velocity differences between the jets may be effectively created by varying the speeds of the pumps that supply the several papermaking stocks to the channels 18, 19 and 20. However, velocity differences may be produced by adjustment of the slice opening by raising or lowering the upper slice lip 37 in the known manner. Alternatively, velocity differences may be created by adjustment of the headbox flow channel geometry. This may be accomplished by constructing the headbox so that either the floor or the ceiling can be moved inwardly or outwardly to change the convergence in one or more of the channels, as illustrated in FIG. 3.

Figure 3:
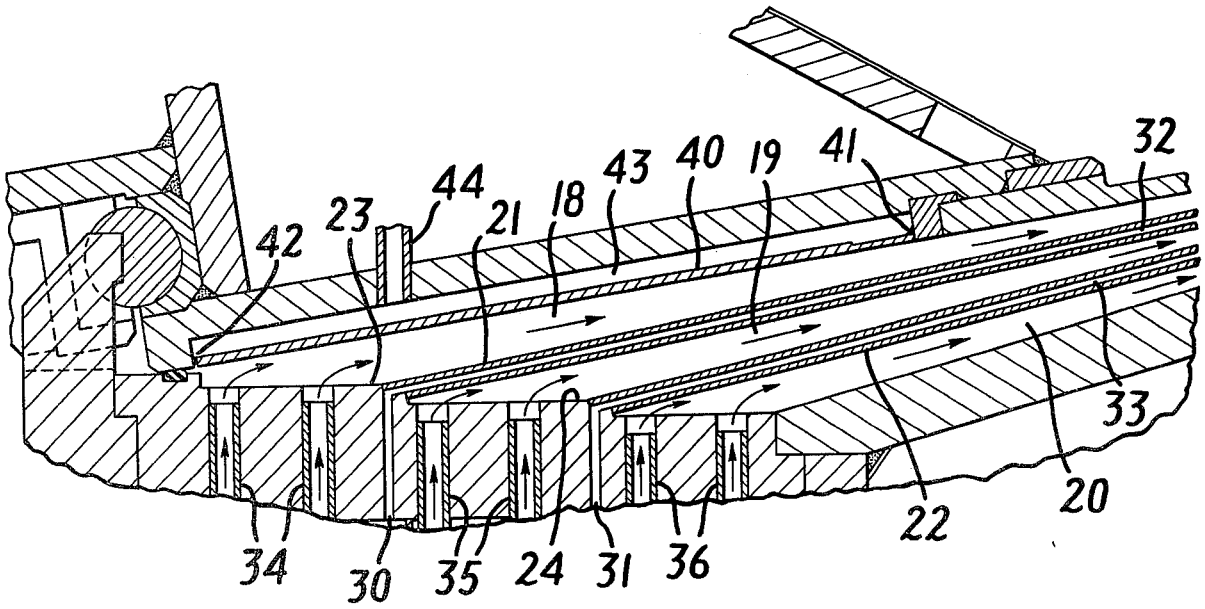
FIG. 3 illustrates schematically a multilayer headbox in which velocity differences in the several channels can be produced by changing the channel convergencies.

In FIG. 3, the headbox 10 is provided with a false ceiling portion 40 secured at a downstream end 41, but free to move at its other end 42. The ceiling portion 40 forms a closure for a shallow chamber 43 which is adapted to receive a suitable fluid under pressure through a conduit 44 from a controlled source (not shown). Conventional sealing means (not shown) is provided at the upstream end 42 of the ceiling portion 40 to permit movement of the latter while preventing leakage either of stock from the channel 18 into the chamber 43, or of the fluid from the chamber 43 into the channel 18.

By controlling the fluid pressure in the chamber 43 relative to the stock flow pressure in the channel 18, the upstream end of the ceiling portion 40 can be caused to deflect to change the convergence of the channel and therefore the stock velocity therein. This causes a pressure difference across the adjacent vane 21 which results in a movement of the downstream end of the vane, so that different jet velocities are produced while the flow rates remain constant.

The invention thus provides a novel and highly effective method for producing multilayer paper of excellent layer purity and formation. By virtue of this highly desirable properties, a greater proportion of less costly fibers can be used without substantially reducing the quality of the paper so that it can be produced at lower cost.

The invention is not limited to the specific embodiment disclosed but encompasses all modifications in form and detail coming within the scope of the following claims.

I claim:

1. In a method for forming paper by supplying paper stock to a converging throat between two foraminous forming fabrics and dewatering and forming said stock by running said forming fabrics along a curved plain surface of a fabric supporting member with said stock therebetween, the steps of discharging into said throat at least two laterally coextensive, sheet-like jets of paper stock in superimposed, spaced apart relation with a gap therebetween, maintaining in the gap between said jets at the discharge location a wedge-shaped body of gaseous fluid at a pressure such that the adjacent faces of the jets gradually approach one another and meet to form a stratified jet as they travel towards the narrow end of said throat, and setting the discharge velocity of the jet closest to the curved plain surface to be higher than that of an adjacent discharged jet by an amount in the range up to 10% but at least 15 to 20 m/min higher.

2. A paper forming method as defined in claim 1 in which the jets are discharged through headbox slice openings and the relative velocities of the discharged jets are set by adjustment of at least one of said slice openings.

3. A paper forming method as defined in claim 1 in which the paper stock forming the discharged jets is supplied to headbox slice openings through stacked flow channels in a headbox and the relative velocities of the discharged jets are set by adjustment of the geometry of at least one of said channels.

4. A paper forming method as defined in claim 1 in which the paper stock forming the discharged jets is supplied to headbox slice openings through stacked flow channels in a headbox and the relative velocities of the discharged jets are set by adjustment of the stock flows through said channels.

5. A paper making method as defined in claim 1 in which the discharged jets are formed of different stocks so as to produce multilayer paper.

* * * * *